US006276329B1

(12) United States Patent
Archer

(10) Patent No.: US 6,276,329 B1
(45) Date of Patent: Aug. 21, 2001

(54) ROTARY MACHINE

(76) Inventor: John Edward Archer, 7 Silver Street, Withersfield, Haverhill, Suffolk (GB), CB9 7SN ( * ) Notice: Subject to any disclaimer, the term of this patent is extended or adjusted under 35 U.S.C. 154(b) by 0 days.

(21) Appl. No.: 09/600,745

(22) PCT Filed: Jan. 19, 1999

(86) PCT No.: PCT/GB99/00172

§ 371 Date: Jul. 20, 2000

§ 102(e) Date: Jul. 20, 2000

(87) PCT Pub. No.: WO99/37886

PCT Pub. Date: Jul. 29, 1999

(30) Foreign Application Priority Data

Jan. 21, 1998 (GB) ..... 9801113

(51) Int. Cl.[7] ..... F02B 53/04
(52) U.S. Cl. ..... 123/228; 418/34; 418/36
(58) Field of Search ..... 123/228, 245, 123/200, 222; 418/34, 36, 35

(56) References Cited

U.S. PATENT DOCUMENTS 150,350 * 4/1874 Palmer ..... 418/34
1,596,375 * 8/1926 Riesenecker ..... 418/34
1,629,580 * 5/1927 Lithander ..... 123/228
3,798,897 * 3/1974 Nutku ..... 418/34
3,909,162 * 9/1975 Nutku ..... 418/34
4,026,249 * 5/1977 Larrea ..... 418/36
4,200,084 * 4/1980 Alexeev et al. ..... 123/228
4,683,852 * 8/1987 Kypreos-Pantazis ..... 123/228

* cited by examiner

*Primary Examiner*—Thomas Denion
*Assistant Examiner*—Thai-Ba Trieu
(74) *Attorney, Agent, or Firm*—Bourque & Associates, P.A.

(57) ABSTRACT

A rotary machine, usable as an engine or as a pump, has a toroidal cylinder (25) which is swept by continuously rotating disc-like piston (34). The cylinder has a double disc valve arrangement (42, 44) at one point, so that it can be divided into a compression side and an expansion side. However the piston has to pass the position of the valve during each revolution, and the valve opens briefly to allow this to happen. The compressed gas is forced into a storage chamber (62) outside the cylinder, and a valve (64) which is operated independently of the double disc valve arrangement (42, 44) is used to determine how much gas is admitted to the combustion chamber **(25*c*)**, and when it is admitted.

8 Claims, 7 Drawing Sheets

ROTARY MACHINE

This invention relates to a rotary machine adaptable for use as an engine or as a pump. The machine is however primarily intended for use as an engine.

Reciprocating internal combustion engines, for example operating on a four-stroke cycle and using petrol or diesel as a fuel are very well known.

The inefficiencies of conventional engines are also well known and significant research and development effort has been expended over more than a century in attempting to provide improved internal combustion engines. Some research has concentrated on trying to improve the basic reciprocating engine, for example by controlling combustion conditions more accurately. Other research has focused on attempting to provide an alternative structure to the basic reciprocating piston engine. The Wankel engine is an example of such a proposal, but this suffers from some of the drawbacks of conventional piston engines and has problems of its own.

Gas turbines do not suffer so much from vibration, but small turbines cannot easily be made efficient.

At present, reciprocating piston internal combustion engines are predominantly used for vehicle propulsion, and, at best, these achieve efficiencies of only about 30%. In addition, measures must be taken to reduce noise and vibration.

According to the invention, there is provided a rotary combustion machine having:

a toroidal cylinder;

a rotor mounted on a shaft for rotation about the cylinder axis;

at least two pistons mounted on the rotor, the pistons having a cross-sectional area substantially equal to the cross-sectional shape of the cylinder, the rotor and pistons being arranged so that as the rotor rotates the pistons sweep the internal volume of the cylinder;

a valve mechanism comprising two parallel contra-rotating plates, each with a cut-out at its periphery, the plates being arranged so that their plane of rotation intersects the cylinder at one point around the cylinder circumference;

a compressed gas outlet leading from the cylinder on one side of the valve mechanism;

a compressed gas chamber for receiving gas from the outlet;

a combustion passage communicating with the compressed gas chamber and leading into the cylinder on the opposite side of the valve mechanism;

a valve, for opening and closing the combustion passage independently of the valve mechanism; and means for igniting a combustible gas mixture in the combustion passage.

The compressed gas chamber is preferably independent of the engine block in which the cylinder is formed, and the combustion passage valve is controlled by a timing mechanism driven from the shaft axis.

It is important that the valve for opening and closing the combustion passage is not tied to the valve mechanism which alternately blocks and unblocks the cylinder. This allows the combustion cycle timing to be set at any time to meet the load conditions imposed on the engine, in the most effective way.

The machine preferably includes an adjustable timing mechanism which allows the timing of the combustion passage valve operation to be varied relative to the valve mechanism. This timing mechanism may be receive input signals/drive from the rotor and/or from other engine parameters such as temperature, operator speed demand input and from other parameters which are known in relation to engine control.

Thus, with this aspect of the invention, a fluid can be positively compressed or expanded in a pressure chamber having a piston member, without requiring reciprocating motion. This can lead to a device which operates with less vibration, more smoothly, and more efficiently.

The or each piston member may be coupled to a rotatably mounted drive member so that, on rotation of the drive member, the or each piston member moves progressively through the chamber. The drive member may be driven by an external torque if the apparatus is arranged as a pump, or may be used to provide a driving torque if the apparatus forms part of a heat engine or turbine.

In one embodiment, the apparatus is arranged as a compression pump, having inlet means for introducing a fluid to be compressed into a portion of the chamber between an approaching face of the piston member and the valve member; means for inhibiting return of fluid through the inlet as the piston member is driven towards the valve member so as to compress fluid trapped in the chamber between the piston member and the valve member; and outlet means for exhausting compressed fluid from the chamber.

In another embodiment, the apparatus is arranged as a vacuum pump or turbine, having fluid introducing means for introducing a fluid to be expanded into a portion of the chamber between the valve member and a receding face of the piston member so as to expand as the piston member recedes from the valve member and means for exhausting expanded fluid from the chamber.

The compression pump and vacuum pump/turbine features may be provided together in the same apparatus. Indeed, the preferred application of the apparatus, a heat engine, incorporates the features of both the turbine and compression pump, further includes means for re-introducing the compressed fluid exhausted from the outlet means through the fluid introducing means and means for supplying heat to the re-introduced fluid. With this arrangement, the work generated by expansion of the heated reintroduced fluid is greater than the work required to compress the fluid, and so network is produced at the drive member.

Although heat could be supplied externally of the fluid, heat is preferably generated by combustion within the fluid, the fluid including oxygen (for example comprising air). Fuel may be burnt either in the chamber, as the fluid expands, or in an external chamber from which the fluid is re-introduced into said chamber, or both.

An advantage of this combustion engine is that the fuel can be burnt more progressively, rather than requiring a violent explosion as in a conventional internal combustion engine, which can enable more complete combustion, and may also reduce the unwanted combustion by-products, such as oxides of nitrogen.

The apparatus may include a fluid storage chamber for storing said compressed fluid prior to re-introduction into the chamber.

Fuel may be burnt before the fluid is reintroduced, as the fluid is reintroduced, or wholly after the fluid has been introduced, or any combination of the above. Preferably, the compressed fluid is re-introduced into the chamber via an ante-chamber in fluid communication with a portion of the chamber near the valve zone, and fuel is ignited in the antechamber.

Preferably, the apparatus (of any of the above aspects or embodiments) has two piston members substantially diametrically opposed. This arrangement offers advantages over a single piston member because no counter-weight is required for balancing. More surprisingly, the arrangement offers advantages over larger numbers of piston members, as the piston may travel almost 180 degrees around the chamber on a power stroke, allowing time to extract maximum energy from the combustion and to allow substantially complete combustion. However, three, four or even more piston members may be provided.

Most preferably, the valve member comprises at least one substantially solid plate, preferably a disk, having at least one hole therein of section corresponding to the section of the chamber, the plate being rotatably mounted about an axis perpendicular to the section of the chamber at the valve zone so that a portion of the plate extends through said section of the chamber, alignment of the or each hole with the valve-zone of the chamber providing an opening through which the or each piston member can pass to provide the open condition of the valve, and alignment of a solid portion of the plate with the valve-zone providing the closed condition of the valve.

Preferably, fluid is admitted to or exhausted from the chamber by means of one or more ducts disposed around the chamber, the ducts being positioned so that movement of the or each piston member within the chamber selectively exposes volumes of fluid disposed between the piston member and the valve member to a respective duct and selectively inhibits fluid communication between a respective volume and the respective duct. In the way, the need for external valves can be reduced or eliminated, the piston member serving additionally as a valve. For example, the inlet means of a compression pump (or corresponding portion of the combustion engine) may be disposed spaced from the valve-zone so as to be in fluid communication with a volume of the chamber.

The invention will now be further described, by way of example, with reference to the accompanying drawings, in which.

Figure 1:
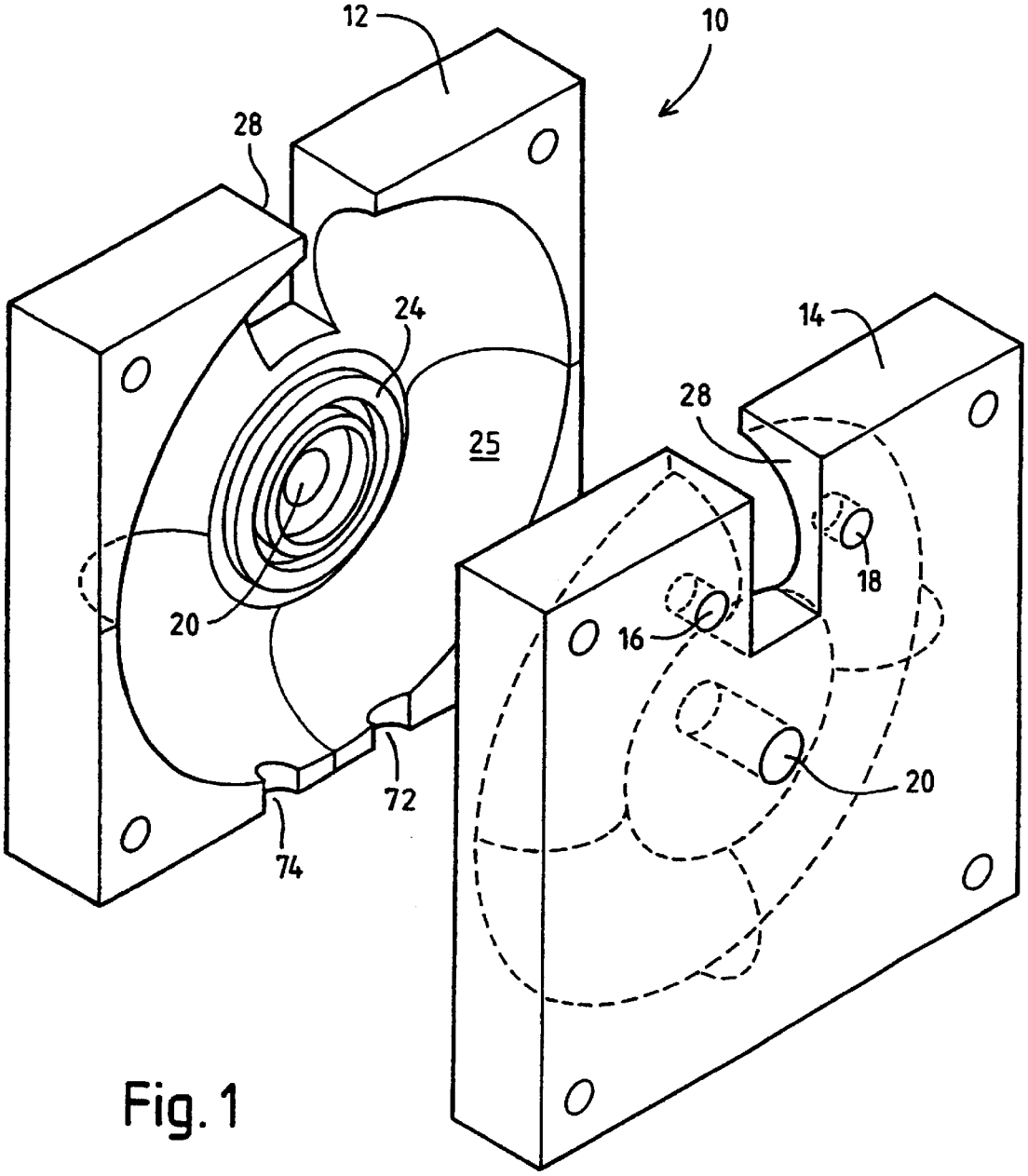
FIG. 1 is an exploded view showing two halves of a cylinder block forming part of an engine in accordance with the invention.

The engine illustrated in the figures has an engine block 10 consisting of two halves 12, 14. As shown in FIG. 1, these are mirror symmetrical, with the exception of inlet and outlet ports 16,18 which, in the Figures, appear only in one half 14. For maximum efficiency there could be inlet and outlet ports in both halves.

Figure 2:
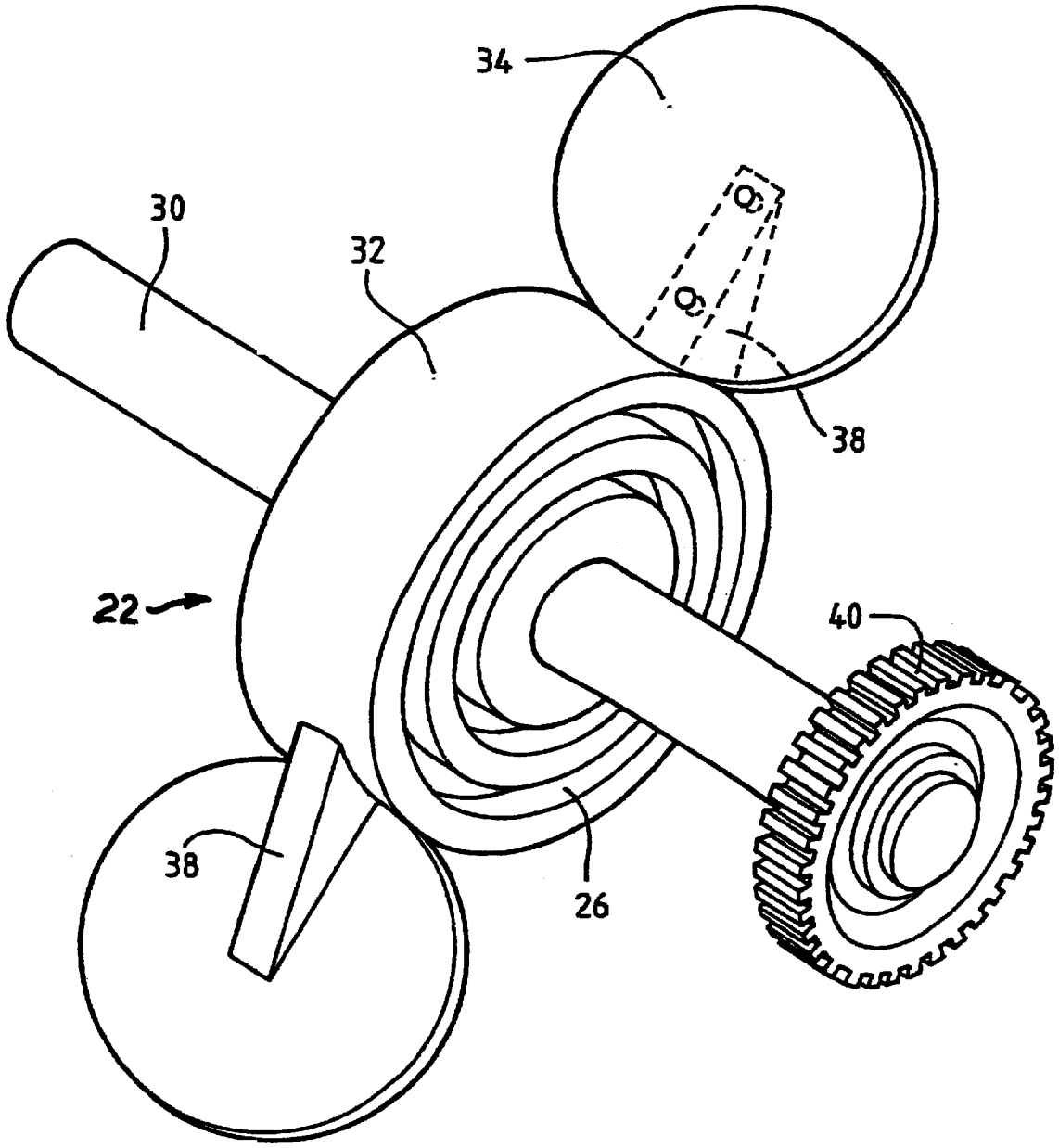
FIG. 2 shows the piston unit for operation within the cylinder block of FIG. 1.

When the two halves are secured together, if necessary with an appropriate gasket between, they will form an enclosed cylindrical or toroidal chamber which forms the cylinder of the engine. Both halves have a bore 20 for receiving a shaft of a piston unit which is shown in FIG. 2 where it is generally designated 22. At the centre of each half is a labyrinth seal arrangement 24 (only visible in FIG. 1 on the half 12) and consisting of alternate grooves and ridges around the axis of the bore 20. The grooves and ridges cooperate with alternating ridges and grooves 26 on the piston unit 22. A labyrinth seal is only one type of suitable seal, aid alternative seal arrangements could be used.

The block 10, when assembled, also has a slot 28 formed partly within each of the halves 12, 14, to accommodate a valve unit which will alternately blocks and unblocks a part of the cylinder circumference. This unit will be described in more detail later on.

The block also has a working fluid inlet 72 and an exhaust outlet 74.

FIG. 2 shows the piston unit 22 which is mounted on a shaft 30 which will run in the bores 20 in the block 10.

Appropriate bearings will be provided to ensure that the shaft 30 will rotate smoothly and freely in the bores 20.

The unit 22 has a central boss 32, and on the circumferential edge of the boss 32 two pistons 34, 36 are mounted. These pistons, as can be seen in FIG. 2, consist of discs, each of which is supported on the circumferential edge of the boss 32 by a buttress 38, the buttresses being in front of the discs 34, 36 when considered in the direction of rotation of the piston unit.

The piston unit 22 and the block 10 are constructed so that when the two halves of the block are assembled to one another, with the piston unit between them, the pistons 34, 36 fit within the cylinder 25, and are freely rotatable in the cylinder. The surface area of the pistons 34 should be such that they occupy the entire cross-sectional area of the cylinder 25, but do not quite touch the surfaces of the cylinder so that when the piston unit rotates in the cylinder the internal volume of the cylinder is swept by the pistons 34, 36. It may be possible to fit piston rings to the circumferential surfaces of the piston, to provide a seal between the piston and the cylinder wall, but this is not preferred. With a fast rotating piston, the losses through the narrow gap between the piston and the cylinder wall will be small, and the benefits of having no contact seal are that there will be no wear to be considered, no lubrication necessary and no resistance to piston rotation as a result of the seal.

The piston unit shaft 30 has a toothed timing wheel 40 to enable the rotation of the piston unit to be synchronised with that of other engine components. The other end of the shaft 30 will form the output shaft of the engine and may carry a flywheel which could have a toothed rim, for engagement with a starter mechanism.

Figure 3:
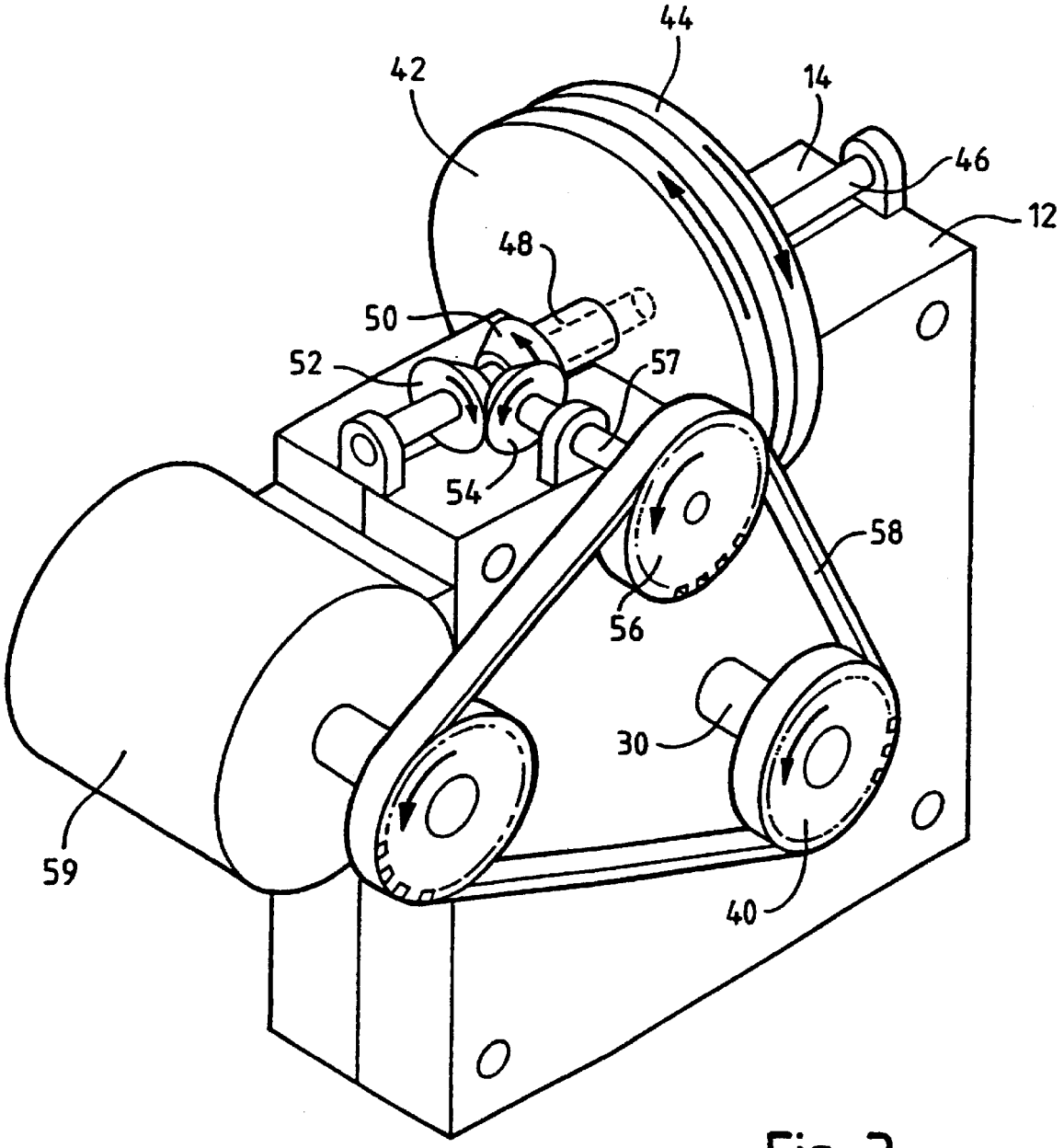
FIG. 3 is a schematic external view of an assembled engine, including two valve discs.

FIG. 3 shows the assembled engine with the two halves 12, 14 assembled and the piston unit 22 inside, and therefore not visible. FIG. 3 illustrates in particular two concentric valve discs 42, 44 which extend into the cylinder 25 through the slot 28. The discs rotate about an axis 45, the disc 44 being mounted on a shaft 46 and the disc 42 on a shaft 48. The shafts 46 and 48 are concentric and are fitted with opposite facing bevel gears 50, 52. Gears 50 and 52 mesh with a third bevel gear 54 mounted on a shaft 57 carrying a toothed wheel 56 which is driven by a belt drive 58 from the toothed wheel 40. In operation, when the wheel 56 is rotated, the bevel gear 54 will rotate and this will cause the meshing gears 50, 52 to rotate in opposite directions to turn the discs 42 and 44 in opposite directions. The drive for the discs 42, 44 from the shaft 30 (ie the diameters of the wheels 40 and 56 and the transmission ratios of the gears 50, 52, 54) will be designed so that the discs rotate at twice the speed of the piston unit 22.

Although FIG. 3 shows the discs 42 and 44 with an apparent separation between them, in practice the discs will be positioned as close together as possible to allow them to rotate in opposite directions without coming into contact with one another.

The timing belt 58, which is driven by the toothed wheel 40, also passes around a pulley of a timing controller 59 (shown schematically, which controls the timing of fuel injection (through an injector 68) and the opening and closing of valves 64, 66 (to be described with reference to FIG. 9).

The diameter of the valve discs 42,44 is such that, if the discs were continuous, they would block the cylinder 25 where they traverse the cylinder.

Figure 4:
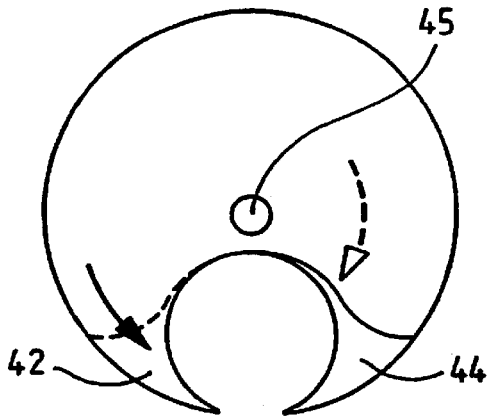
FIGS. 4–8 show schematically five different relative positions of the two valve discs.

However the discs 42, 44 are not continuous and each has a cut-out region around its periphery, the shapes of these cut-outs being shown in FIG. 4 where the outline of the disc 42 is shown in solid lines and the outline of the disc 44 is shown in dotted lines behind.

FIG. 4 shows a position where the parts of the two discs which coincide open a circular passage through the valve discs 42, 44 and through which the pistons 34, 36 can pass. It is desirable that the passage past the valve plates should open suddenly immediately before the approach of a piston 34, 36, and should close again immediately the piston has passed through. This is achieved as a result of the rotational speed of the valve discs being twice that of the piston unit.

Figure 5:
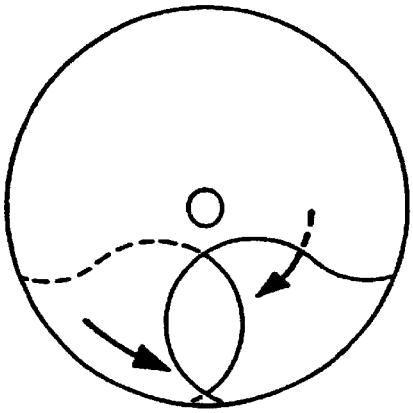
Figure 6:
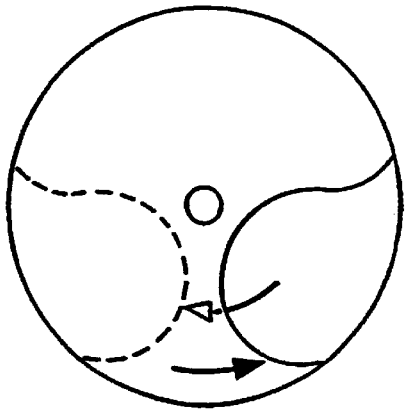
Figure 7:
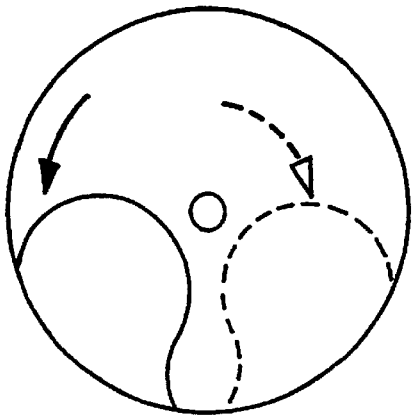
Figure 8:
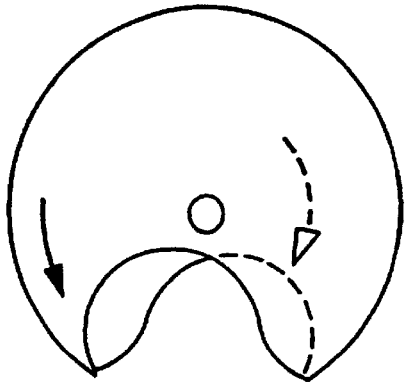

In FIG. 5, the opening 60 is nearly completely closed. In FIG. 6, the opening is now closed and remains closed for the next approximately 300 degrees of rotation of the discs, up to the position of FIG. 7, where the opening is just about to open and FIG. 8 where it begins to open to a sufficient extent to allow the buttress 38 to pass through in advance of a piston disc which passes through once the opening 60 is completely circular.

By using two discs in this way, which open and close the opening 60 from opposite directions, the fastest possible opening and closing of the opening is achieved.

Figure 9:
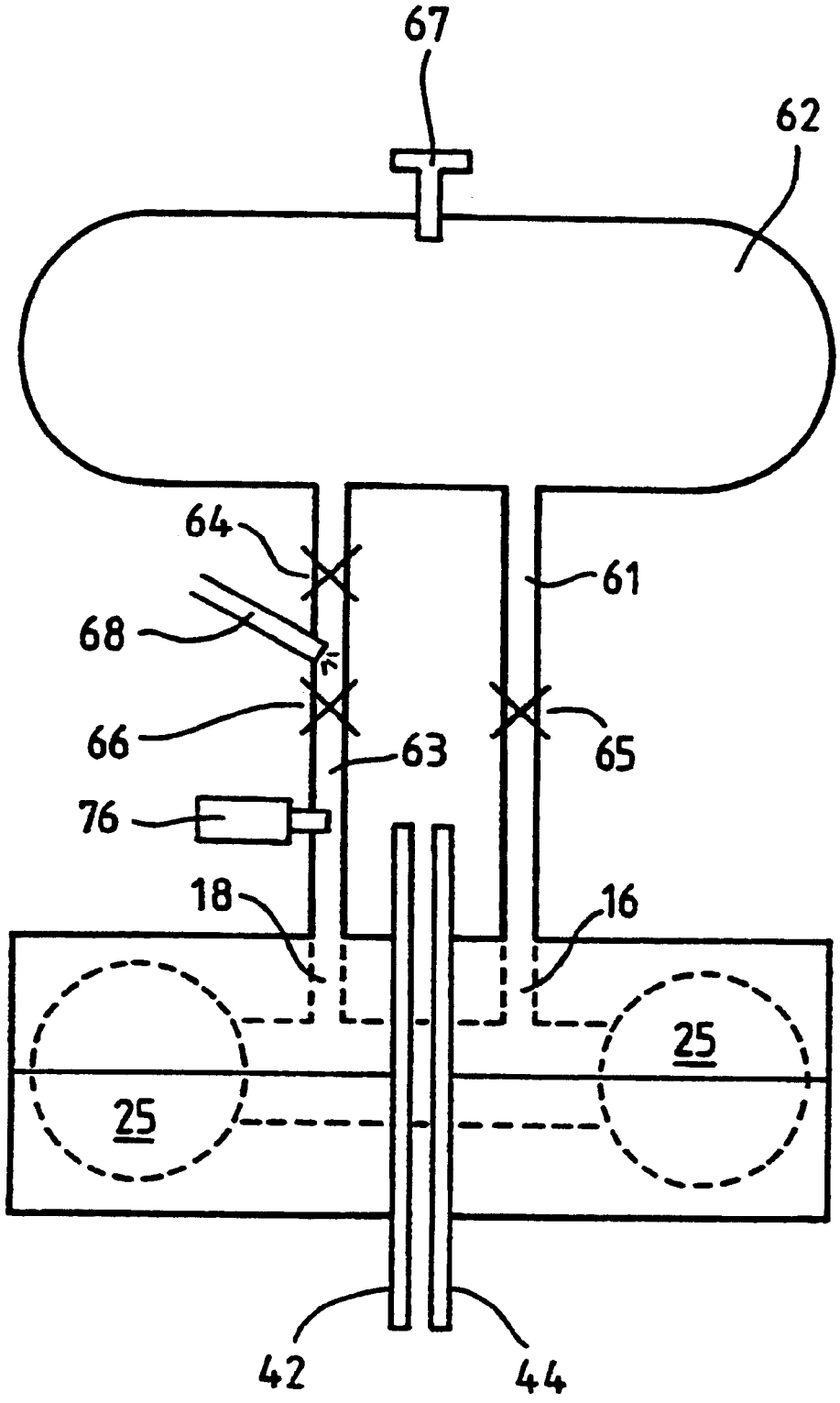
FIG. 9 is a plan view of the engine, schematically showing the external compressed gas chamber.

FIG. 9 is a schematic plan view of the engine showing the cylinder 25 and the outlet and inlet ports 16 and 18. The outlet port 16 is in communication with a pressure chamber 62 via a feed line 61, and a return line 63 leads from the pressure chamber 62 into the cylinder inlet port 18. The pressure chamber 62 has a pressure relief valve 67. The feed line 61 includes a one way valve 65 which allows flow from the port 16 to the chamber 62 but prevents flow in the opposite direction. The return line 63 includes a controllable valve 64 and a one-way valve 66 which allows flow from the chamber 62 into the port 18 but prevents flow in the opposite direction. The return line 63 also includes a fuel injector 68 and a spark plug 76, these items being positioned with respect to the valves 64, 66 as shown in FIG. 9.

Operation of the engine will now be described with reference to FIGS. 10, 11 and 12 which show three different stages in one operating cycle.

Figure 10:
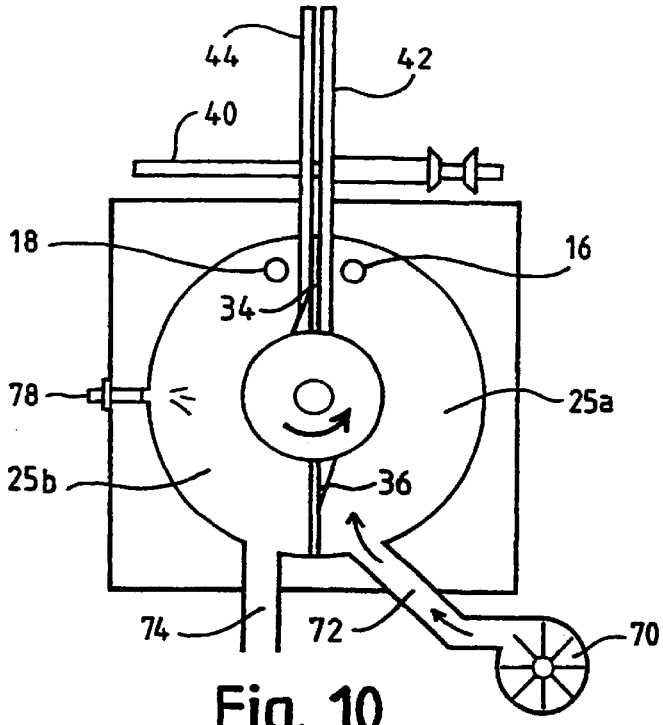
FIGS. 10, 11 and 12 are side views, taken in cross section, of the engine showing three different stages in an operational cycle.

In the first position, shown in FIG. 10, the pistons 34 and 36 divide the cylinder 25 into a right hand half and a left hand half. In the right hand half 25*a*, which is the induction side, air (or a combustible gas mixture) has been drawn into the cylinder during the preceding half revolution and/or has been blown into the right hand half by a blower 70 which communicates with a cylinder inlet 72.

On the left-hand, drive side 25*b* of the cylinder, the cylinder internal volume is open to the exhaust port 74, so that gas not used in the drive stroke can be exhausted at the end of the drive stroke.

Figure 11:
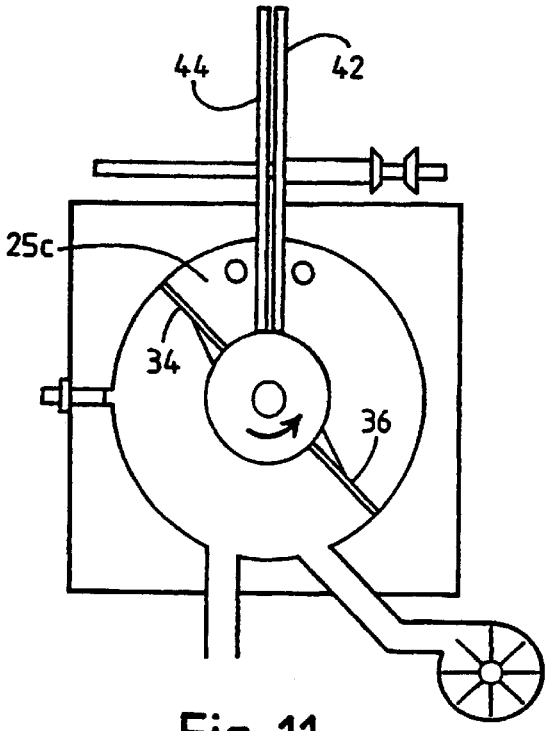

In the next stage, shown in FIG. 11, the pistons have moved on, and the induction side 25*a* of the cylinder is enclosed between the advancing piston 34 and the closed valve plates 42, 44. The gas mixture in the right hand cylinder half 25*a* is compressed and driven through the outlet 16 into the external chamber 62.

However, on the left-hand side of the engine, the piston 36 has passed the valve unit 42, 44 which is now closed and the valve 64 can open for a short time to allow compressed air from the chamber 62 to enter the combustion space 25*c*. Whilst the gas is flowing into the combustion space 25*c*, fuel can be injected through the injector 68. Once the desired volume of gas and fuel has entered the chamber 25*c*, and has passed the one-way valve 66, a spark can be ignited by a spark plug 76 to cause an explosion in the chamber 25*c* which drives the piston 36 in an anticlockwise direction (referred to the engine orientation as shown in the drawings) to produce the drive stroke of the engine.

At the same time, if the blower 70 is still operating, the air being blown into the cylinder will assist in driving out spent exhaust gases through the exhaust port 74.

Figure 12:
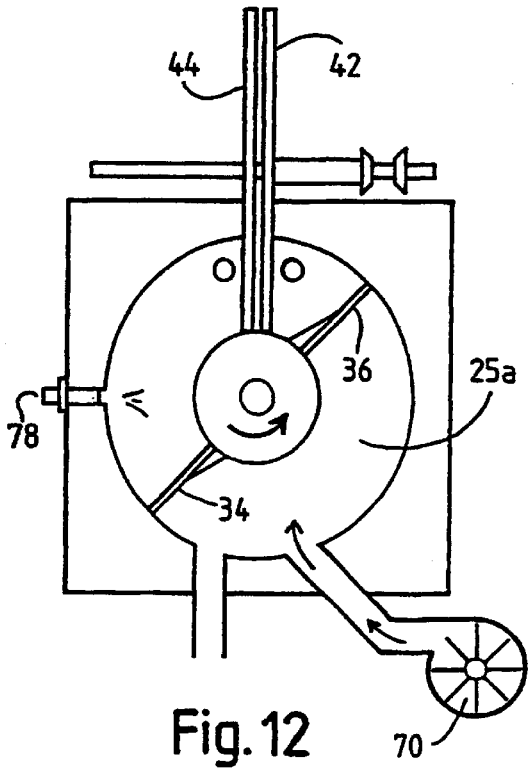

In the next stage, shown in FIG. 12, the piston 36 has moved further on and a new charge of gas is being drawn into the induction chamber 25*a*.

It is possible, during the driving stroke of the engine, for water to be injected into the chamber 25*c* through a water injector 78. The water vapourises and the resulting increase in volume contributes to engine cooling, to the driving force on the piston 36 and to cleaning up of engine emissions.

The operation of the engine in this way continues to drive the piston unit in rotation, and the rotation of the piston unit shaft 30 can be used to drive an external device.

Figure 13:
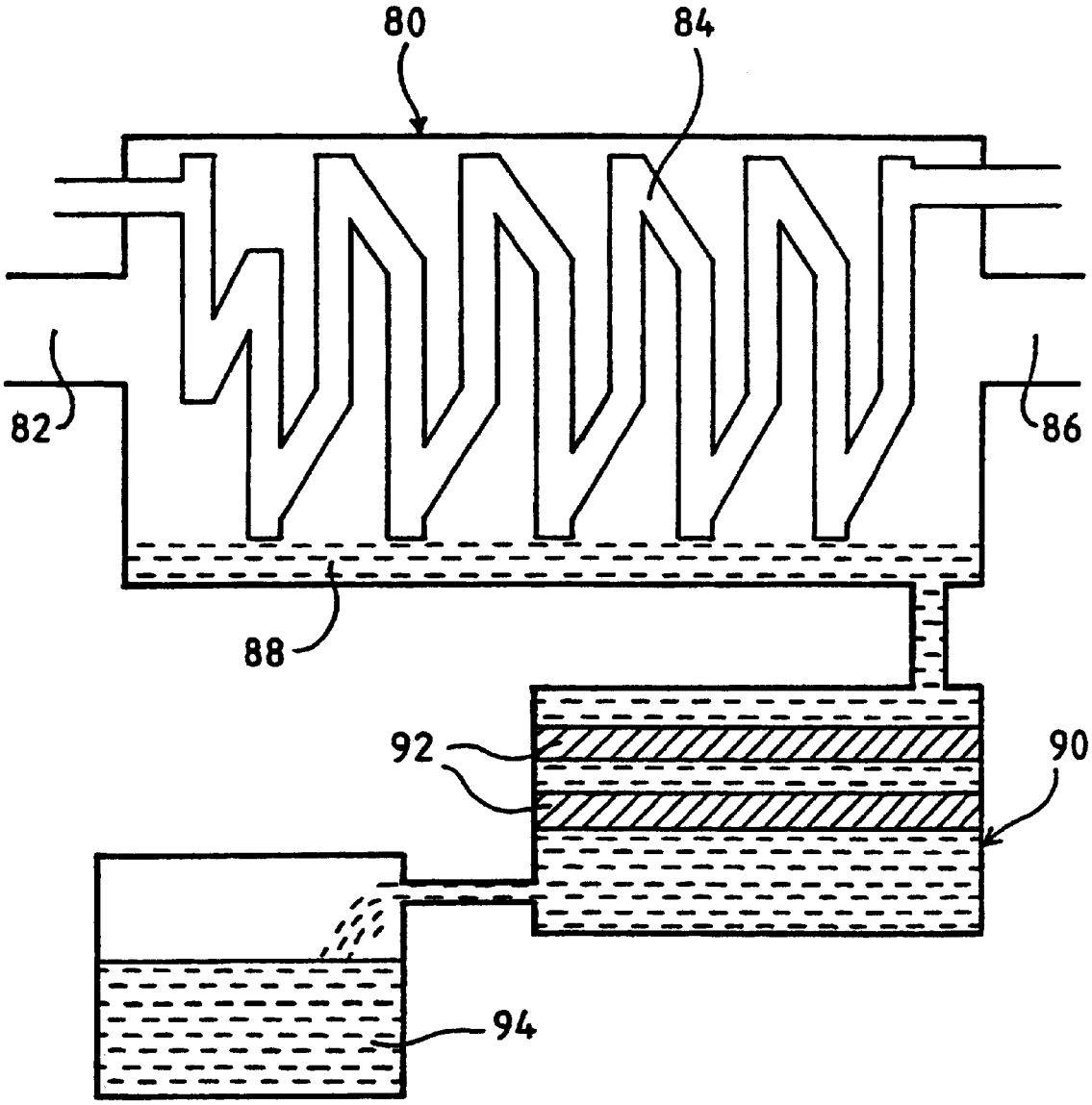
FIG. 13 is a schematic illustration of an exhaust gas cleaning unit for use with the engine shown in FIGS. 1 to 12.

The exhaust gases pass from the exhaust port 74 to an exhaust gas cleaning unit shown in FIG. 13. The hot exhaust gases include condensable vapours, in particular steam, which carry undesirable products resulting from the combustion of fuel in the engine. The hot gases enter a heat exchanger/condenser 80 through an inlet 82. In the condenser, they flow in heat exchange relationship with a cooling fluid flowing through cooling galleries 84 before leaving, as a clean, cooled gas flow, through an outlet 86. The condensable fraction of the exhaust gases collects in liquid form 88 at the bottom of the condenser 80, and this condensate is drained out, under gravity, to a filter unit 90. In the filter unit, the condensate passes through filter beds 92 to remove solid material. It may be possible to include appropriate media (eg catalysts) to remove (possibly through precipitation and filtration) undesirable products which have remained in solution in the condensate.

Cleaned condensate can then be collected from the bottom of the filter unit and stored in a tank 94. If this condensate is water, it can be returned to the water injection feed to the engine. Alternatively it can simply be discharged to atmosphere where it will cause no pollution problems, since it has been cleaned.

The filter unit 90, or at least the filter media 92 within the unit, can be changed periodically and either discarded or regenerated.

It is hoped that the combination of this exhaust gas cleaning together with the water injection already described will allow complete water recirculation between the engine and the exhaust system.

The engine described here, with its exhaust gas cleaning system, is environmentally friendly and non-polluting through a number of different measures described above. The use of an axially symmetric rotor ensures that the engine can operate in a smooth manner without the vibrations imposed by the reciprocating piston motion of a conventional internal combustion engine. As a result, the engine will run very smoothly and energy will not be wasted in constantly retarding and accelerating the moving masses. The rotor will run continuously at a constant speed, unless the operator calls for acceleration or deceleration, but even in this case the change in rotor motion will be smooth. Because of this, the engine described here can be significantly more energy efficient than conventional reciprocating engines.

It will be understood that, in common with most fluid displacement machines, the piston unit can be driven by an external power source, and fluid can be pumped through the cylinder.

The engine can be operated either with an external combustion or (as described here) with internal combustion. In the case of external combustion, a volume of compressed gas will be combusted in a chamber such as chamber 62, and then valves can be opened to admit the highly compressed gas mixture to the cylinder region 25*c*.

What is claimed is:

1. A rotary combustion machine having:

a toroidal cylinder;

a rotor mounted on a shaft for rotation about an axis of said cylinder;

at least two pistons mounted on the rotor, the pistons having a cross-sectional area substantially equal to the cross-sectional shape of the cylinder, the rotor and pistons being arranged so that as the rotor rotates the pistons sweep the internal volume of the cylinder;

a valve mechanism comprising two parallel contra-rotating plates, each with a cut-out at its periphery, the plates being arranged so that their plane of rotation intersects the cylinder at one point around the cylinder circumference;

a compressed gas outlet leading from the cylinder on one side of the valve mechanism;

a compressed gas chamber for receiving gas from the outlet;

a combustion passage leading into the cylinder on the opposite side of the valve mechanism;

a valve, for opening and closing the combustion passage independently of the valve mechanism;

means for igniting a combustible gas mixture in the combustion passage; and a working fluid inlet to and an exhaust outlet from the cylinder to, respectively, admit fluid to and exhaust fluid from opposite sides of the valve mechanism, the working fluid inlet and exhaust outlet being in positions which, referred to the diameter of the toroidal cylinder, are substantially diametrically opposite to the valve mechanism.

2. The machine of claim 1, including an adjustable timing mechanism which allows the timing of the combustion passage valve operation to be varied relative to the valve mechanism.

3. The machine of claim 2, wherein the timing mechanism is adapted to receive input signals/drive from the rotor and/or from other engine parameters such as temperature, operator speed demand input and from other parameters which are known in relation to engine control.

4. The machine of claim 1, wherein there are two substantially diametrically opposed pistons.

5. The machine of claim 1, wherein the compressed gas chamber is external to the casing which defines the cylinder.

6. The machine of claim 1, wherein the working fluid inlet and the exhaust outlet are positioned so that movement of the pistons within the chamber selectively exposes volumes of fluid disposed between a piston and the valve mechanism to a respective one of the inlet and outlet and selectively inhibits fluid communication between a respective volume and the respective one of the inlet and outlet.

7. The machine of claim 1, wherein the rotor is mounted on a rotor shaft, and a flywheel is also mounted on the rotor shaft.

8. The machine of claim 1, including means for injecting water into the chamber, between the valve mechanism and the exhaust outlet.

* * * * *